US005669312A

United States Patent [19]

Norton

[11] Patent Number: 5,669,312

[45] Date of Patent: Sep. 23, 1997

[54] BAR RAIL COMFORT TRAY

[76] Inventor: Donald J. Norton, 100 Victoria Heights, Hyde Park, Mass. 02136

[21] Appl. No.: 600,094

[22] Filed: Feb. 12, 1996

[51] Int. Cl.[6] ..... A47B 23/00

[52] U.S. Cl. ..... 108/42; 403/104; 108/147; 108/158; 108/155; 108/156; 108/154

[58] Field of Search ..... 248/188, 188.1; 403/104, 106, 107, 108; 108/144, 147, 154, 155, 42, 156, 157, 186

[56] References Cited

U.S. PATENT DOCUMENTS

| | | | |
|---|---|---|---|
| D. 323,447 | 1/1992 | Booz | D7/616 |
| D. 332,895 | 2/1993 | Salzmann | D7/590 |
| 2,756,082 | 7/1956 | Pucci | 403/107 |
| 2,935,813 | 5/1960 | Berman et al. | 108/144 |
| 3,164,351 | 1/1965 | Rembowski | 403/108 X |
| 3,653,341 | 4/1972 | Nielsen | 108/144 |
| 3,709,158 | 1/1973 | Kidd | 108/43 |
| 3,709,166 | 1/1973 | Bush | 108/144 X |
| 4,229,917 | 10/1980 | Textoris et al. | 248/188 X |
| 4,357,881 | 11/1982 | De Long | 108/49 |
| 4,892,044 | 1/1990 | Welsch | 108/154 |
| 5,383,411 | 1/1995 | Tomaka et al. | 108/129 |
| 5,390,803 | 2/1995 | McAllister | 108/144 X |

*Primary Examiner*—Peter M. Cuomo
*Assistant Examiner*—Stephen Vu
*Attorney, Agent, or Firm*—Richard L. Miller, P.E.

[57] ABSTRACT

A bar rail comfort tray that includes a flat rectangular-shaped tray portion, a pair of short front legs, and a pair of long rear legs. The flat rectangular-shaped tray portion has a pair of skewed front corners and a pair of skewed rear corners. Each of the pair of short front legs extend downwardly from each of the pair of skewed front corners of the flat rectangular-shaped tray portion and have a shaped free end. Each of the pair of long rear legs extend downwardly from each of the pair of skewed rear corners of the flat rectangular-shaped tray portion and have a flat free end. And, when the bar rail comfort tray is positioned on a bar rail of a conventional bar, the flat rectangular-shaped tray portion is substantially on a top of the bar rail of the conventional bar, the shaped free end of each of the pair of short front legs rests on a shaped front of the bar rail of the conventional bar, and the pair of long rear legs are behind a rear of the bar rail of the conventional bar with the flat free end of each of the pair of long rear legs resting on the conventional bar.

13 Claims, 3 Drawing Sheets

BAR RAIL COMFORT TRAY

BACKGROUND OF THE INVENTION

The present invention relates to a bar rail comfort tray. More particularly, the present invention relates to a bar rail comfort tray that includes a flat tray that has a pair of front skew corners and a pair of rear skew corners, each of a pair of height adjustable front leg assemblies extends downwardly from each of the pair of front skew corners of the flat tray, and each of a pair of height and lateral adjustable rear leg assemblies extends downwardly from each of the pair of rear skew corners of the flat tray.

People are known to frequent cafes, restaurants, barrooms, and the like. During such visits the people can eat directly at the bar where they also may be drinking. When eating at the bar, however, due to the presence of the bar rail, many problems are presented. For example, the food is not close to the patron, the patron has to lean forward over the bar rail making it very uncomfortable to eat and causes the patron's chest to be pressed against the bar rail, and elbow room between patrons is minimized.

Numerous innovations for trays have been provided in the prior art that will be described. However, even though these innovations may be suitable for the specific individual purposes to which they address, they differ from the present invention in that they do not teach a bar rail comfort tray that includes a flat tray that has a pair of front skew corners and a pair of rear skew corners, each of a pair of height adjustable front leg assemblies extends downwardly from each of the pair of front skew corners of the flat tray, and each of a pair of height and lateral adjustable rear leg assemblies extends downwardly from each of the pair of rear skew corners of the flat tray.

FOR EXAMPLE, U.S. Pat. No. Des. 323,447 to Booz teaches a food bar tray that includes a rectangular-shaped tray surface with a plurality of different sized apertures disposed therethrough and rectangular shaped sides extending downwardly therefrom having hand slots disposed therethrough.

ANOTHER EXAMPLE, U.S. Pat. No. Des. 332,895 to Salzmann teaches a bar condiment tray that includes a hollow open topped parallelepiped-shaped container with a rectangular-shaped cover removably mounted at, and closing, the open top of the hollow open topped parallelepiped-shaped container.

STILL ANOTHER EXAMPLE, U.S. Pat. No. 3,709,158 to Kidd teaches a serving tray that includes a rectangular-shaped tray with a lower surface and a pair of clampable legs pivotally mounted to the lower surface of the rectangular-shaped tray.

YET ANOTHER EXAMPLE, U.S. Pat. No. 4,357,881 to De Long teaches a hospital bed tray that is attachable to the side rail of a hospital bed and collapsible downward from the upper rung of the side rail.

FINALLY, STILL YET ANOTHER EXAMPLE, U.S. Pat. No. 5,383,411 to Tomaka et al. teaches a tray assembly that includes a rectangular-shaped tray, a pair of end sides extending downwardly from the rectangular-shaped tray, and a pair of adjustable legs pivotally and slidably mounted to the pair of end sides.

It is apparent that numerous innovations for trays have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a bar rail comfort tray that avoids the disadvantages of the prior art.

ANOTHER OBJECT of the present invention is to provide a bar rail comfort tray that is simple and inexpensive to manufacture.

STILL ANOTHER OBJECT of the present invention is to provide a bar rail comfort tray that is simple to use.

YET ANOTHER OBJECT of the present invention is to provide a bar rail comfort tray that can be used in cafes, restaurants, barrooms, and the like.

STILL YET ANOTHER OBJECT of the present invention is to provide a bar rail comfort tray that allows people to eat comfortably at the bar where they also may be drinking.

YET STILL ANOTHER OBJECT of the present invention is to provide a bar rail comfort tray that eliminates the problems presented when eating at the bar due to the presence of the bar rail.

STILL YET ANOTHER OBJECT of the present invention is to provide a bar rail comfort tray that can be removably and adjustably positioned over a conventional bar rail.

YET STILL ANOTHER OBJECT of the present invention is to provide a bar rail comfort tray that can be safely hooked behind the bar rail, preventing food and drink disposed thereon from accidently falling in the patron's lap.

STILL YET ANOTHER OBJECT of the present invention is to provide a bar rail comfort tray that allow the food to be positioned close to the patron.

YET STILL ANOTHER OBJECT of the present invention is to provide a bar rail comfort tray that eliminates the need for the patron to have to lean forward over the bar rail making it very uncomfortable to eat.

STILL YET ANOTHER OBJECT of the present invention is to provide a bar rail comfort tray that eliminates the need for the patron's chest to have to be pressed against the bar rail.

YET STILL ANOTHER OBJECT of the present invention is to provide a bar rail comfort tray maximizes and elbow room between patrons.

BRIEFLY STATED, STILL YET ANOTHER OBJECT of the present invention is to provide a bar rail comfort tray that includes a flat rectangular-shaped tray portion, a pair of short front legs, and a pair of long rear legs.

YET STILL ANOTHER OBJECT of the present invention is to provide a bar rail comfort tray wherein the flat rectangular-shaped tray portion has a pair of skewed front corners and a pair of skewed rear corners.

STILL YET ANOTHER OBJECT of the present invention is to provide a bar rail comfort tray wherein each of the pair of short front legs extend downwardly from each of the pair of skewed front corners of the flat rectangular-shaped tray portion and have a shaped free end.

YET STILL ANOTHER OBJECT of the present invention is to provide a bar rail comfort tray wherein each of the pair of long rear legs extend downwardly from each of the pair of skewed rear corners of the flat rectangular-shaped tray portion and have a flat free end.

STILL YET ANOTHER OBJECT of the present invention is to provide a bar rail comfort tray wherein when the bar rail comfort tray is positioned on a bar rail of a conventional bar, the flat rectangular-shaped tray portion is substantially on a top of the bar rail of the conventional bar, the shaped free end of each of the pair of short front legs rests on a shaped front of the bar rail of the conventional bar, and the pair of long rear legs are behind a rear of the bar rail of the conventional bar with the flat free end of each of the pair of long rear legs resting on the conventional bar.

YET STILL ANOTHER OBJECT of the present invention is to provide a bar rail comfort tray wherein the flat rectangular-shaped tray portion, the short front legs, and the long rear legs are integral.

STILL YET ANOTHER OBJECT of the present invention is to provide a bar rail comfort tray wherein the integral flat rectangular-shaped tray portion, the short front legs, and the long rear legs is a material selected from the group consisting of wood, plastic, and stainless steel.

YET STILL ANOTHER OBJECT of the present invention is to provide a bar rail comfort tray wherein the flat rectangular-shaped tray portion has shaped edges.

BRIEFLY STATED, STILL YET ANOTHER OBJECT of the present invention is to provide a bar rail comfort tray that includes a flat rectangular-shaped tray portion, a pair of adjustable front leg assemblies, and a pair of adjustable rear leg assemblies.

YET STILL ANOTHER OBJECT of the present invention is to provide a bar rail comfort tray wherein the flat rectangular-shaped tray portion has a pair of skewed front corners and a pair of skewed rear corners.

STILL YET ANOTHER OBJECT of the present invention is to provide a bar rail comfort tray wherein each of the pair of adjustable front leg assemblies is disposed in proximity of each of the pair of skewed front corners of the flat rectangular-shaped tray portion and extends downwardly therefrom.

YET STILL ANOTHER OBJECT of the present invention is to provide a bar rail comfort tray wherein each of the pair of adjustable front leg assemblies has a free end.

STILL YET ANOTHER OBJECT of the present invention is to provide a bar rail comfort tray wherein each of the pair of adjustable rear leg assemblies is disposed in proximity of each of the pair of skewed rear corners of the flat rectangular-shaped tray portion and extending downwardly therefrom.

YET STILL ANOTHER OBJECT of the present invention is to provide a bar rail comfort tray wherein each of the pair of adjustable rear leg assemblies having a free end.

STILL YET ANOTHER OBJECT of the present invention is to provide a bar rail comfort tray wherein when the bar rail comfort tray is positioned on a bar rail of a conventional bar the flat rectangular-shaped tray portion is substantially on a top of the bar rail of the conventional bar, the free end of each of the pair of adjustable front leg assemblies rests on a shaped front of the bar rail of the conventional bar, and the pair of adjustable rear leg assemblies are behind a rear of the bar rail of the conventional bar with the free end of each of the pair of adjustable rear leg assemblies resting on the conventional bar.

YET STILL ANOTHER OBJECT of the present invention is to provide a bar rail comfort tray wherein the flat rectangular-shaped tray portion, the adjustable front leg assemblies, and the adjustable rear leg assemblies are a material selected from the group consisting of wood, plastic, and stainless steel.

STILL YET ANOTHER OBJECT of the present invention is to provide a bar rail comfort tray wherein the pair of adjustable front leg assemblies are adjustable in height and the pair of adjustable rear leg assemblies are adjustable in height and lateral position.

YET STILL ANOTHER OBJECT of the present invention is to provide a bar rail comfort tray wherein each of the pair of adjustable front leg assemblies includes a tubular body with a proximal end, a distal free end, and a threaded inner surface.

STILL YET ANOTHER OBJECT of the present invention is to provide a bar rail comfort tray wherein each of the pair of adjustable front leg assemblies further includes at least two expandable longitudinal V-shaped slots disposed at the distal free end of the tubular body of each of the pair of adjustable front leg assemblies.

YET STILL ANOTHER OBJECT of the present invention is to provide a bar rail comfort tray wherein each of the pair of adjustable front leg assemblies further includes a small disk fixedly attached to the proximal end of the tubular body of each of the pair of front leg assemblies.

STILL YET ANOTHER OBJECT of the present invention is to provide a bar rail comfort tray wherein each of the pair of adjustable front leg assemblies further includes a large disk fixedly attached between the flat rectangular-shaped tray portion and the small disk of each of the pair of adjustable front leg assemblies.

YET STILL ANOTHER OBJECT of the present invention is to provide a bar rail comfort tray wherein each of the pair of adjustable front leg assemblies further includes a threaded rod threadably mounted in the tubular body of each of the pair of adjustable front leg assemblies at the threaded inner surface of the tubular body of each of the pair of adjustable front leg assemblies and has a free end assembly.

STILL YET ANOTHER OBJECT of the present invention is to provide a bar rail comfort tray wherein the free end assembly of the threaded rod of each of the pair of adjustable front leg assemblies include a lateral throughbore, a hemispherical socket, a ball rotatively mounted in the hemispherical socket of the free end assembly of the threaded rod of each of the pair of adjustable front leg assemblies and forms a ball and socket joint therewith, and a foot disk fixedly attached to the ball of the free end assembly of the threaded rod of each of the pair of adjustable front leg assemblies.

YET STILL ANOTHER OBJECT of the present invention is to provide a bar rail comfort tray wherein each of the pair of adjustable rear leg assemblies includes a tubular body with a proximal end, a distal free end, and a threaded inner surface.

STILL YET ANOTHER OBJECT of the present invention is to provide a bar rail comfort tray wherein each of the pair of adjustable rear leg assemblies further includes at least two expandable longitudinal V-shaped slots disposed at the distal free end of the tubular body of each of the pair of adjustable rear leg assemblies.

YET STILL ANOTHER OBJECT of the present invention is to provide a bar rail comfort tray wherein each of the pair of adjustable rear leg assemblies further includes a small disk with a thickness and a diameter that is fixedly attached to the proximal end of the tubular body of each of the pair of rear leg assemblies.

STILL YET ANOTHER OBJECT of the present invention is to provide a bar rail comfort tray wherein each of the pair of adjustable rear leg assemblies further includes a threaded rod threadably mounted in the tubular body of each of the pair of adjustable rear leg assemblies at the threaded inner surface of the tubular body of each of the pair of adjustable rear leg assemblies and has a free end assembly.

YET STILL ANOTHER OBJECT of the present invention is to provide a bar rail comfort tray wherein the free end assembly of the threaded rod of each of the pair of adjustable rear leg assemblies include a lateral throughbore, a hemispherical socket, a ball rotatively mounted in the hemispherical socket of the free end assembly of the threaded rod of each of the pair of adjustable rear leg assemblies and forms a ball and socket joint therewith, and a foot disk fixedly attached to the ball of the free end assembly of the threaded rod of each of the pair of adjustable rear leg assemblies.

STILL YET ANOTHER OBJECT of the present invention is to provide a bar rail comfort tray wherein each of the pair of adjustable rear leg assemblies further includes a substantially rectangular-shaped lateral adjusting plate assembly fixedly attached to the flat rectangular-shaped tray portion in proximity of each of the pair of tray portion skewed rear corners of the flat rectangular-shaped tray portion and slidably receives each of the pair of adjustable rear leg assemblies so that lateral position of each of the pair of adjustable rear leg assemblies can be adjusted.

YET STILL ANOTHER OBJECT of the present invention is to provide a bar rail comfort tray wherein the substantially rectangular-shaped lateral adjusting plate assembly includes a substantially rectangular-shaped raised portion that has a pair ends.

STILL YET ANOTHER OBJECT of the present invention is to provide a bar rail comfort tray wherein the substantially rectangular-shaped lateral adjusting plate assembly further includes an L-shaped mounting bracket that attaches each of the pair of ends of the substantially rectangular-shaped raised portion of the substantially rectangular-shaped lateral adjusting plate assembly to the flat rectangular-shaped tray portion and defines a chamber therebetween that has a height.

YET STILL ANOTHER OBJECT of the present invention is to provide a bar rail comfort tray wherein the height of the chamber substantially equal to the thickness of the small disk of each of the pair of adjustable rear leg assemblies so that the small disk of each of the pair of adjustable rear leg assemblies fits snugly between the flat rectangular-shaped tray portion and the substantially rectangular-shaped raised portion of the substantially rectangular-shaped lateral adjusting plate assembly.

STILL YET ANOTHER OBJECT of the present invention is to provide a bar rail comfort tray wherein the substantially rectangular-shaped raised portion of the substantially rectangular-shaped lateral adjusting plate assembly further has a length, a longitudinal centerline, and a longitudinally disposed rectangular-shaped throughslot with a width that is disposed substantially along the length of the substantially rectangular-shaped raised portion of the substantially rectangular-shaped lateral adjusting plate assembly and to one side of the longitudinal centerline of the substantially rectangular-shaped raised portion of the substantially rectangular-shaped lateral adjusting plate assembly.

YET STILL ANOTHER OBJECT of the present invention is to provide a bar rail comfort tray wherein the substantially rectangular-shaped raised portion of the substantially rectangular-shaped lateral adjusting plate assembly further has at least two laterally disposed arcuate-shaped throughslots with a width that are disposed on the opposite side of the longitudinal centerline of the substantially rectangular-shaped raised portion of the substantially rectangular-shaped lateral adjusting plate assembly and open into the longitudinally disposed rectangular-shaped throughslot of the substantially rectangular-shaped raised portion of the substantially rectangular-shaped lateral adjusting plate assembly, so that when lateral position of each of the pair of adjustable rear leg assemblies is to be adjusted each of the pair of adjustable rear leg assemblies, with the small disk of each of the pair of rear leg assemblies movable in the chamber of the substantially rectangular-shaped lateral adjusting plate assembly, is slid across the longitudinally disposed rectangular-shaped throughslot of the substantially rectangular-shaped raised portion of the substantially rectangular-shaped lateral adjusting plate assembly and into a selected one of the at least two laterally disposed arcuate-shaped throughslots of the substantially rectangular-shaped raised portion of the substantially rectangular-shaped lateral adjusting plate assembly.

STILL YET ANOTHER OBJECT of the present invention is to provide a bar rail comfort tray wherein the diameter of the small disk of each of the pair of adjustable rear leg assemblies is greater than the width of the longitudinally disposed rectangular-shaped throughslot of the substantially rectangular-shaped raised portion of the substantially rectangular-shaped lateral adjusting plate assembly and greater than the width of each of the at least two laterally disposed arcuate-shaped throughslots of the substantially rectangular-shaped raised portion of the substantially rectangular-shaped lateral adjusting plate assembly, so that each of the pair of adjustable rear leg assemblies can not be unintentionally removed from the substantially rectangular-shaped lateral adjusting plate assembly during adjustment thereof.

FINALLY, YET STILL ANOTHER OBJECT of the present invention is to provide a bar rail comfort tray that further includes a leg height adjusting rod that is removably insertable into the lateral throughbore of the free end assembly of each of the pair of adjustable front leg assemblies and of each of the pair of adjustable rear leg assemblies, so that the threaded rod of each of the pair of front leg assemblies and of each the pair of adjustable rear leg assemblies can be rotated, and extended from and retracted into, the tubular body of each of the pair of adjustable front leg assemblies and of each of the pair of adjustable rear leg assemblies.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

| Preferred Embodiment | |
|---|---|
| 10 | comfort tray of the present invention |
| 12 | conventional bar rail |
| 14 | conventional bar |
| 16 | plate of food |
| 18 | drink |
| 20 | patron |
| 22 | conventional bar stool |
| 24 | patron hands |
| 26 | flat rectangular-shaped tray portion |
| 28 | pair of tray portion skewed front corners |
| 30 | pair of tray portion skewed rear corners |
| 32 | short front leg |
| 33 | short front leg shaped free end |
| 34 | long rear leg |
| 35 | long rear leg flat free end |
| 36 | conventional bar rail top |
| 38 | conventional shaped bar rail front |
| 40 | conventional bar rail rear |

| Alternate Embodiment | |
|---|---|
| 110 | comfort tray |
| 126 | flat rectangular-shaped tray portion |
| 128 | pair of tray portion skewed front corners |
| 130 | pair of tray portion skewed rear corners |
| 132 | height adjustable front leg assembly |
| 134 | height and lateral adjustable rear leg assembly |
| 142 | height adjustable leg assembly tubular body |
| 144 | height adjustable leg assembly tubular body proximal end |
| 146 | height adjustable leg assembly tubular body distal free end |
| 148 | height adjustable leg assembly tubular body threaded inner surface |
| 150 | at least two height adjustable leg assembly tubular body distal free end expandable longitudinal V-shaped slots |
| 152 | height adjustable leg assembly tubular body proximal end small disk |
| 154 | height adjustable leg assembly tubular body proximal end large disk |
| 156 | height adjustable leg assembly threaded rod |
| 158 | height adjustable leg assembly threaded rod free end assembly |
| 160 | height adjustable leg assembly threaded rod free end assembly lateral throughbore |
| 162 | height adjustable leg assembly threaded rod free end assembly hemispherical socket |
| 163 | height adjustable leg assembly threaded rod free end assembly ball and socket joint |
| 164 | height adjustable leg assembly threaded rod free end assembly ball |
| 166 | height adjustable leg assembly threaded rod free end assembly foot disk |
| 168 | substantially rectangular-shaped lateral adjusting plate assembly |
| 170 | substantially rectangular-shaped lateral adjusting plate assembly raised portion |
| 172 | pair of lateral adjusting plate assembly raised portion ends |
| 174 | L-shaped lateral adjusting plate assembly mounting bracket |
| 175 | lateral adjusting plate assembly chamber |
| 176 | lateral adjusting plate assembly raised portion longitudinally disposed rectangular-shaped throughslot |
| 178 | at least two lateral adjusting plate assembly raised portion laterally disposed arcuate-shaped throughslots |
| 180 | leg height adjusting rod |

DETAILED DESCRIPTION OF THE PREFERRED EMBODIMENT

Figure 1:
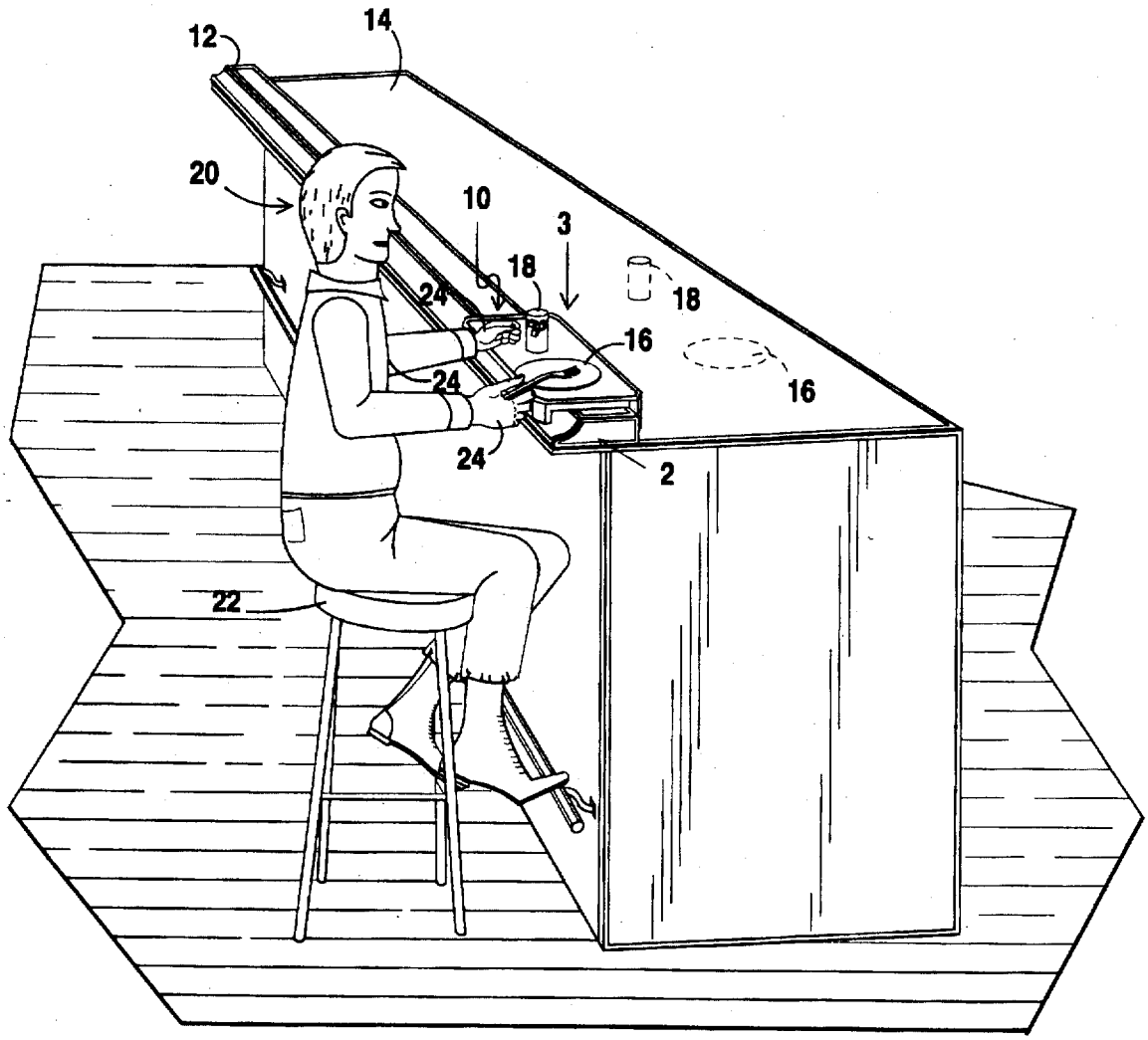
FIG. 1 is a diagrammatic perspective view of a first embodiment of the present invention in use on a bar counter top.

Referring now to the figures in which like numerals indicate like parts, and particularly to FIG. 1, the comfort tray of the present invention is shown generally at 10, straddling a conventional bar rail 12 of a conventional bar 14 and having disposed thereon a plate of food 16 and a drink 18. A patron 20 sitting on a conventional bar stool 22 is accessing the plate of food 16 and the drink 18 with patron hands 26 of the patron 20.

For sake of illustrating the prior art positioning of the plate of food 16 and the drink 18, the plate of food 16 and the drink 18 are also shown in phantom lines.

The configuration of the preferred embodiment of the bar rail comfort tray 10 can best be seen in FIGS. 2 and 3, and as such, will be discussed with reference thereto.

The bar rail comfort tray 10 includes a flat rectangular-shaped tray portion 26 that has a pair of tray portion skewed front corners 28 and a pair of tray portion skewed rear corners 30.

The flat rectangular-shaped tray portion 26 may be 10 inches long and 8 inches wide, or be appropriately sized for the conventional bar rail (not shown) of the conventional bar (not shown). The flat rectangular-shaped tray portion 126 may be made of wood, plastic, stainless steel, or the like and may have shaped edges, but is not limited to that.

A short front leg 32 extends downwardly from, and may integrally formed with, each of the pair of tray portion skewed front corners 28 of the flat rectangular-shaped tray portion 26 and has a short front leg shaped free end 33. The short front leg 32 may be made from wood, plastic, stainless steel, or the like, but is not limited to that.

A long rear leg 34 extends downwardly from, and may be integrally formed with, each of the pair of tray portion skewed rear corners 30 of the flat rectangular-shaped tray portion 26 and has a long rear leg flat free end 35. The long leg 34 may be made from wood, plastic, stainless steel, or the like, but is not limited to that.

Figure 2:
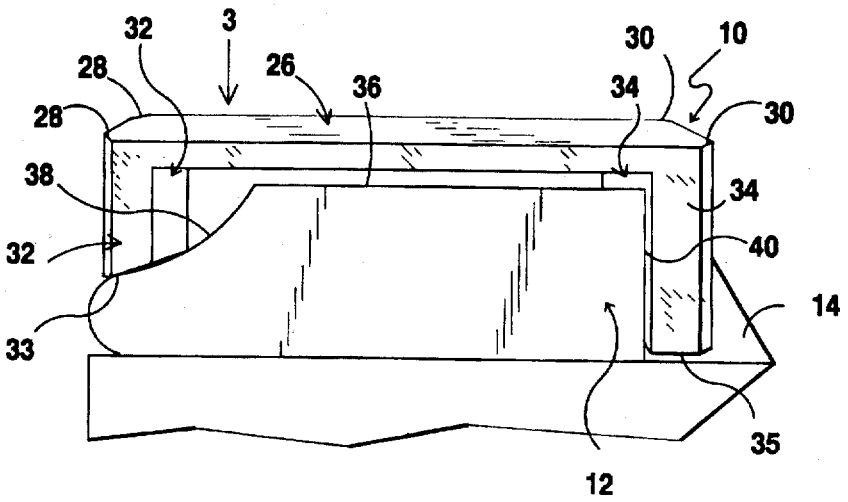
FIG. 2 is a diagrammatic perspective view taken in the direction of arrow 2 in FIG. 1.
Figure 3:
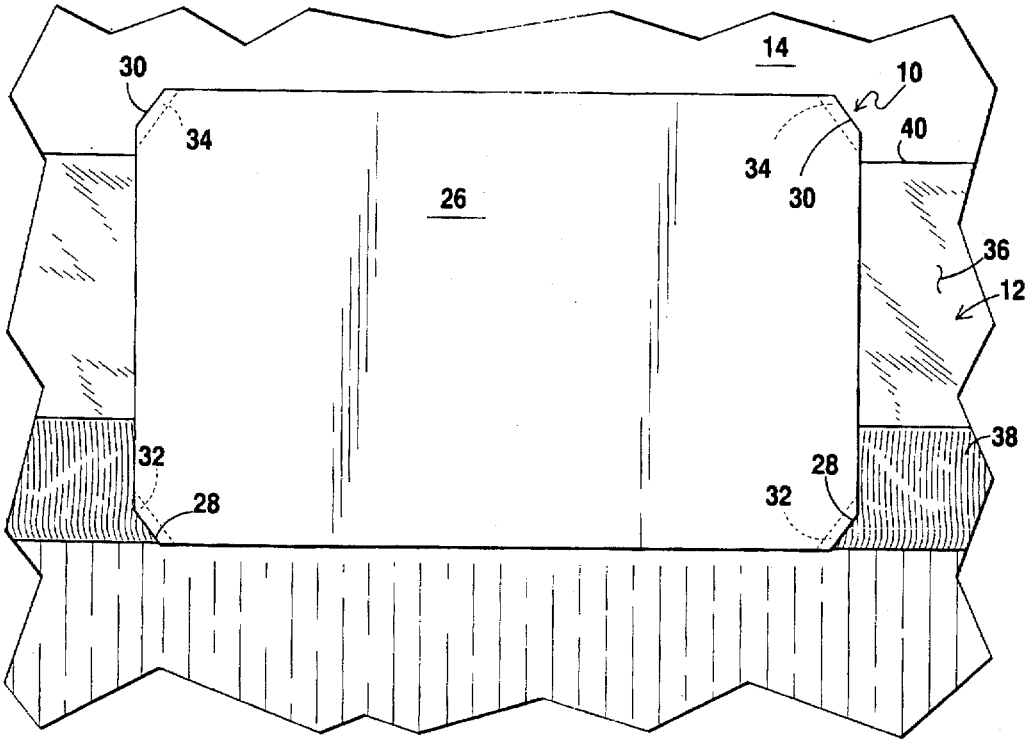
FIG. 3 is a top plan view taken in the direction of arrow 3 in both FIGS. 1 and 2.

As shown in FIG. 2, the bar rail comfort tray 10 is positioned with the flat rectangular-shaped tray portion 26 substantially on a conventional bar rail top 36 of the conventional bar rail 12 of the conventional bar 14, the short front leg shaped free end 33 of the short front leg 32 resting on a conventional shaped bar rail front 38 of the conventional bar rail 12 of the conventional bar 14, and the long rear leg 34 behind a conventional bar rail rear 40 of the conventional bar rail 12 of the conventional bar 14 with the long rear leg flat free end 35 of the long rear leg 34 resting on the conventional bar 14.

Figure 4:
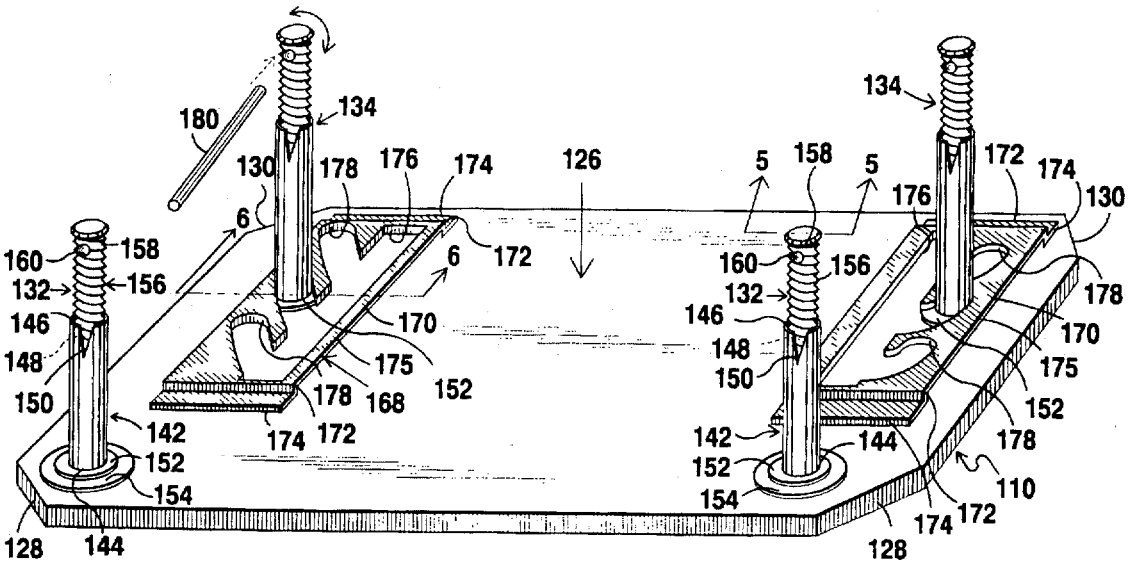
FIG. 4 is a diagrammatic perspective view of an alternate embodiment of the present invention illustrating the adjustable legs.

The configuration of the alternate embodiment of the bar rail comfort tray 110 can best be seen in FIGS. 4–6, and as such will be discussed with reference thereto.

The bar rail comfort tray 110 includes a flat rectangular-shaped tray portion 126 with a pair of tray portion skewed front corners 128 and a pair of tray portion skewed rear corners 130.

The flat rectangular-shaped tray portion 126 may be 10 inches long and 8 inches wide, or be appropriately sized for the conventional bar rail (not shown) of the conventional bar (not shown). The flat rectangular-shaped tray portion 126 may be made of wood, plastic, stainless steel, or the like and may have shaped edges, but is not limited to that.

A height adjustable front leg assembly 132 is disposed in proximity of each of the pair of tray portion skewed front corners 128 of the flat rectangular-shaped tray portion 126 and extend downwardly therefrom.

Each height adjustable front leg assembly 132 is adjustable in both height and free end orientation depending upon the height and contour of the conventional bar rail contoured front (not shown) of the conventional bar rail (not shown) of the conventional bar (not shown). The components of each height adjustable front leg assembly 132 may be made of plastic, stainless steel, or the like, but is not limited to that.

A height and lateral adjustable rear leg assembly 134 is disposed in proximity of each of the pair of tray portion skewed rear corners 130 of the flat rectangular-shaped tray portion 126 and extend downwardly therefrom.

Each height and lateral adjustable rear leg assembly 134 is adjustable in height, free end orientation, and lateral position depending upon the height and depth of the conventional bar rail rear (not shown) of the conventional bar rail (not shown) of the conventional bar (not shown). The components of each height and lateral adjustable rear leg assembly 134 may be made of plastic, stainless steel, or the like, but is not limited to that.

Each height adjustable front leg assembly 132 includes a height adjustable leg assembly tubular body 142 with a height adjustable leg assembly tubular body proximal end 144, a height adjustable leg assembly tubular body distal free end 146, and a height adjustable leg assembly tubular body threaded inner surface 148.

At least two height adjustable leg assembly tubular body distal free end expandable longitudinal V-shaped slots 150 are disposed at the height adjustable leg assembly tubular body distal free end 146 of the height adjustable leg assembly tubular body 142 of each height adjustable front leg assembly 132.

A height adjustable leg assembly tubular body proximal end small disk 152 is fixedly attached to the height adjustable leg assembly tubular body proximal end 144 of the height adjustable leg assembly tubular body 142 of each height adjustable front leg assembly 132.

A height adjustable leg assembly tubular body proximal end large disk 154 is fixedly attached between the flat rectangular-shaped tray portion 126 and the height adjustable leg assembly tubular body proximal end small disk 152 of each height adjustable front leg assembly 132.

A height adjustable leg assembly threaded rod 156 is threadably mounted in the height adjustable leg assembly tubular body 142 of each height adjustable front leg assembly 132 at the height adjustable leg assembly tubular body threaded inner surface 148 of each height adjustable front leg assembly 132 and has a height adjustable leg assembly threaded rod free end assembly 158.

Figure 5:
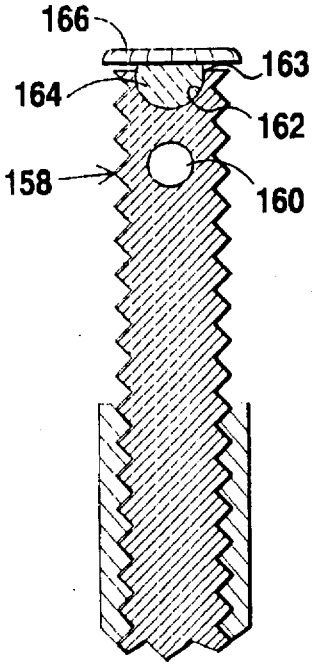
FIG. 5 is a cross sectional view taken on line 5—5 in FIG. 4.
Figure 6:
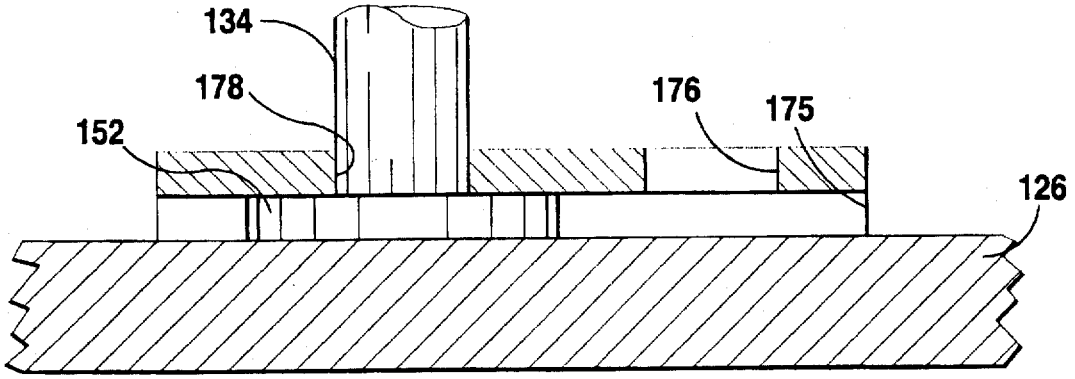
FIG. 6 is a cross sectional view taken on line 6—6 in FIG. 4.

As shown in FIG. 5, the height adjustable leg assembly threaded rod free end assembly 158 of each height adjustable front leg assembly 132 includes a height adjustable leg assembly threaded rod free end assembly lateral throughbore 160, and a height adjustable leg assembly threaded rod free end assembly hemispherical socket 162.

A height adjustable leg assembly threaded rod free end assembly ball 164 is rotatively mounted in the height adjustable leg assembly threaded rod free end assembly hemispherical socket 162 of the height adjustable leg assembly threaded rod free end assembly 158 of each height adjustable front leg assembly 132 and forms a height adjustable leg assembly threaded rod free end assembly ball and socket joint 163 therewith.

A height adjustable leg assembly threaded rod free end assembly foot disk 166 is fixedly attached to the height adjustable leg assembly threaded rod free end assembly ball 164 of the height adjustable leg assembly threaded rod free end assembly 158 of each height adjustable front leg assembly 132.

The provision of the height adjustable leg assembly threaded rod 156 of each height adjustable front leg assembly 132 being threadably mounted to the height adjustable front leg assembly tubular body threaded inner surface 148 of each height adjustable front leg assembly 132 allows each height adjustable front leg assembly 132 to adjust to the height of the conventional bar rail shaped front (not shown) of the conventional bar rail (not shown) of the conventional bar (not shown).

The provision of the height adjustable leg assembly threaded rod free end assembly ball and socket joint 163 of the height adjustable leg assembly threaded rod free end assembly 158 of each height adjustable front leg assembly 132 allows each height adjustable front leg assembly 132 to adjust to the contour of the conventional bar rail shaped front (not shown) of the conventional bar rail (not shown) of the conventional bar (not shown).

The provision of the at least two height adjustable leg assembly tubular body distal free end expandable longitudinal V-shaped slots 150 of the height adjustable leg assembly tubular body distal free end 146 of the height adjustable leg assembly tubular body 142 of each height adjustable front leg assembly 132 allows the height adjustable leg assembly threaded rod 156 of each height adjustable front leg assembly 132 to fit tightly in the height adjustable leg assembly tubular body 142 of each height adjustable front leg assembly 132 and prevents unwanted turning thereto.

The configuration of each height and lateral adjustable rear leg assembly 134 is identical to that of each height adjustable front leg assembly 132 except that no height adjustable leg assembly tubular body proximal end large disk 154 of each height adjustable front leg assembly 132 is present.

A substantially rectangular-shaped lateral adjusting plate assembly 168 is fixedly attached to the flat rectangular-shaped tray portion 126 in proximity of each of the pair of tray portion skewed rear corners 130 of the flat rectangular-shaped tray portion 126 and slidably receives each height and lateral adjustable rear leg assembly 134 so that the lateral position of each height and lateral adjustable rear leg assembly 134 can be adjusted to the various depths of the conventional bar rail (not shown) of the conventional bar (not shown).

The substantially rectangular-shaped lateral adjusting plate assembly 168 includes a substantially rectangular-shaped lateral adjusting plate assembly raised portion 170 that has a pair of lateral adjusting plate assembly raised portion ends 172.

An L-shaped lateral adjusting plate assembly mounting bracket 174 attaches each of the pair of lateral adjusting plate assembly raised portion ends 172 of the substantially rectangular-shaped lateral adjusting plate assembly raised portion 170 of the substantially rectangular-shaped lateral adjusting plate assembly 168 to the flat rectangular-shaped tray portion 126 and defines a lateral adjusting plate assembly chamber 175 therebetween.

Each L-shaped lateral adjusting plate assembly mounting bracket 174 displaces the substantially rectangular-shaped lateral adjusting plate assembly raised portion 170 of the substantially rectangular-shaped lateral adjusting plate assembly 168 from the flat rectangular-shaped tray portion 126 a distance substantially equal to the thickness of the adjustable leg assembly tubular body proximal end small disk 152 each height adjustable rear leg assembly 134 so that the adjustable leg assembly tubular body proximal end small disk 152 each height adjustable rear leg assembly 134 fits snugly therebetween.

The substantially rectangular-shaped lateral adjusting plate assembly raised portion 170 of the substantially rectangular-shaped lateral adjusting plate assembly 168 further has a lateral adjusting plate assembly raised portion longitudinally disposed rectangular-shaped throughslot 176 disposed substantially along its entire length and to one side of its longitudinal centerline.

The substantially rectangular-shaped lateral adjusting plate assembly raised portion 170 of the substantially rectangular-shaped lateral adjusting plate assembly 168 further has at least two lateral adjusting plate assembly raised portion laterally disposed arcuate-shaped throughslots 178 that are disposed on the opposite side of its longitudinal centerline and open into the lateral adjusting plate assembly raised portion longitudinally disposed rectangular-shaped throughslot 176 of the substantially rectangular-shaped lateral adjusting plate assembly raised portion 170 of the substantially rectangular-shaped lateral adjusting plate assembly 168.

When the lateral position of each height and lateral adjustable rear leg assembly 134 is to be adjusted, each height and lateral adjustable rear leg assembly 134 is slid across the lateral adjusting plate assembly raised portion longitudinally disposed rectangular-shaped throughslot 176 of the substantially rectangular-shaped lateral adjusting plate assembly raised portion 170 of the substantially rectangular-shaped lateral adjusting plate assembly 168, with the height adjustable leg assembly tubular body proximal end small disk 152 of each height adjustable rear leg assembly 134 movable in the lateral adjusting plate assembly chamber 175 of each substantially rectangular-shaped lateral adjusting plate assembly 168, and into a selected one of the at least two lateral adjusting plate assembly raised portion laterally disposed arcuate-shaped throughslots 178 of the substantially rectangular-shaped lateral adjusting plate assembly raised portion 170 of the substantially rectangular-shaped lateral adjusting plate assembly 168.

It is to be understood that the diameter of the height adjustable leg assembly tubular body proximal end small disk 152 of each height adjustable rear leg assembly 134 is greater than the width of the lateral adjusting plate assembly raised portion longitudinally disposed rectangular-shaped throughslot 176 of the substantially rectangular-shaped lateral adjusting plate assembly raised portion 170 of the substantially rectangular-shaped lateral adjusting plate assembly 168 and greater than the width of the at least two lateral adjusting plate assembly raised portion laterally disposed arcuate-shaped throughslots 178 of the substantially rectangular-shaped lateral adjusting plate assembly raised portion 170 of the substantially rectangular-shaped lateral adjusting plate assembly 168 so that each height and lateral adjustable rear leg assembly 134 can not be unintentionally removed from the substantially rectangular-shaped lateral adjusting plate assembly 168 during adjustment thereof.

A leg height adjusting rod 180 is removably insertable into the height adjustable leg assembly threaded rod free end assembly lateral throughbore 160 of the height adjustable leg assembly threaded rod free end assembly 158 of each height adjustable front leg assembly 132 and of each height and lateral adjustable rear leg assembly 134 so that the height adjustable leg assembly threaded rod 156 of each height adjustable front leg assembly 132 and of each height and lateral adjustable rear leg assembly 134 can be rotated, and extended from or retracted into, the height adjustable leg assembly tubular body 142 of each height adjustable front leg assembly 132 and of each height and lateral adjustable rear leg assembly 134.

It will be understood that each of the elements described above, or two or more together, may also find a useful application in other types of constructions differing from the types described above.

While the invention has been illustrated and described as embodied in a comfort tray, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An adjustable bar rail comfort tray, comprising:

a) a flat rectangular-shaped tray portion having a front, a rear, a pair of skewed front corners, and a pair of skewed rear corners;

b) a pair of adjustable front leg assemblies, each of which being disposed in proximity of each of said pair of skewed front corners of said flat rectangular-shaped tray portion and extending downwardly therefrom; each of said pair of adjustable front leg assemblies having a free end; said pair of adjustable front leg assemblies being adjustable in height; each of said pair of adjustable front leg assemblies including a tubular body with a proximal end, a distal free end, and a threaded inner surface; each of said pair of adjustable front leg assemblies further including at least two expandable longitudinal V-shaped slots disposed at said distal free end of said tubular body of each of said pair of adjustable front leg assemblies; each of said pair of adjustable front leg assemblies further including a small disk fixedly attached to said proximal end of said tubular body of each of said pair of front leg assemblies; each of said pair of adjustable front leg assemblies further including a large disk fixedly attached between said flat rectangular-shaped tray portion and said small disk of each of said pair of adjustable front leg assemblies; and c) a pair of adjustable rear leg assemblies, each of which being disposed in proximity of each of said pair of skewed rear corners of said flat rectangular-shaped tray portion and extending downwardly therefrom; said pair of adjustable rear leg assemblies being adjustable in height and adjustable in a position between said front of said flat rectangular-shaped tray portion and said rear of said flat rectangular-shaped tray portion; each of said pair of adjustable rear leg assemblies having a free end, so that when said bar rail comfort tray is positioned on a conventional bar rail of a conventional bar, said flat rectangular-shaped tray portion is substantially on a conventional bar rail top of the conventional bar rail of the conventional bar, said free end of each of said pair of adjustable front leg assemblies rests on a conventional bar rail shaped front of the conventional bar rail of the conventional bar, and said pair of adjustable rear leg assemblies are behind a conventional bar rail rear of the conventional bar rail of the conventional bar with said free end of each of said pair of adjustable rear leg assemblies resting on the conventional bar.

2. The tray as defined in claim 1, wherein said flat rectangular-shaped tray portion, said adjustable front leg assemblies, and said adjustable rear leg assemblies are a material selected from the group consisting of wood, plastic, and stainless steel.

3. The tray as defined in claim 1, wherein each of said pair of adjustable front leg assemblies further includes a threaded rod threadably mounted in said tubular body of each of said pair of adjustable front leg assemblies at said threaded inner surface of said tubular body of each of said pair of adjustable front leg assemblies and has a free end assembly.

4. The tray as defined in claim 3, wherein said free end assembly of said threaded rod of each of said pair of adjustable front leg assemblies include a lateral throughbore, a hemispherical socket, a ball rotatively mounted in said hemispherical socket of said free end assembly of said threaded rod of each of said pair of adjustable front leg assemblies and forms a ball and socket joint therewith, and a foot disk fixedly attached to said ball of said free end assembly of said threaded rod of each of said pair of adjustable front leg assemblies.

5. The tray as defined in claim 4, wherein each of said pair of adjustable rear leg assemblies includes a tubular body with a proximal end, a distal free end, and a threaded inner surface, each of said pair of adjustable rear leg assemblies further includes at least two expandable longitudinal V-shaped slots disposed at said distal free end of said tubular body of each of said pair of adjustable rear leg assemblies, each of said pair of adjustable rear leg assemblies further includes a small disk with a thickness and a diameter that is fixedly attached to said proximal end of said tubular body of each of said pair of rear leg assemblies.

6. The tray as defined in claim 5, wherein each of said pair of adjustable rear leg assemblies further includes a threaded rod threadably mounted in said tubular body of each of said pair of adjustable rear leg assemblies at said threaded inner surface of said tubular body of each of said pair of adjustable rear leg assemblies and has a free end assembly.

7. The tray as defined in claim 6, wherein said free end assembly of said threaded rod of each of said pair of adjustable rear leg assemblies include a lateral throughbore, a hemispherical socket, a ball rotatively mounted in said hemispherical socket of said free end assembly of said threaded rod of each of said pair of adjustable rear leg assemblies and forms a ball and socket joint therewith, and a foot disk fixedly attached to said ball of said free end assembly of said threaded rod of each of said pair of adjustable rear leg assemblies.

8. The tray as defined in claim 7, wherein each of said pair of adjustable rear leg assemblies further includes a substantially rectangular-shaped lateral adjusting plate assembly fixedly attached to said flat rectangular-shaped tray portion in proximity of each of said pair of tray portion skewed rear corners of said flat rectangular-shaped tray portion and slidably receives each of said pair of adjustable rear leg assemblies so that lateral position of each of said pair of adjustable rear leg assemblies can be adjusted.

9. The tray as defined in claim 8, wherein said substantially rectangular-shaped lateral adjusting plate assembly includes a substantially rectangular-shaped raised portion that has a pair ends.

10. The tray as defined in claim 9, wherein said substantially rectangular-shaped lateral adjusting plate assembly further includes an L-shaped mounting bracket that attaches each of said pair of ends of said substantially rectangular-shaped raised portion of said substantially rectangular-shaped lateral adjusting plate assembly to said flat rectangular-shaped tray portion and defines a chamber therebetween that has a height, said height of said chamber substantially equal to said thickness of said small disk of each of said pair of adjustable rear leg assemblies so that said small disk of each of said pair of adjustable rear leg assemblies fits snugly between said flat rectangular-shaped tray portion and said substantially rectangular-shaped raised portion of said substantially rectangular-shaped lateral adjusting plate assembly.

11. The tray as defined in claim 10, wherein said substantially rectangular-shaped raised portion of said substantially rectangular-shaped lateral adjusting plate assembly further has a length, a longitudinal centerline, and a longitudinally disposed rectangular-shaped throughslot with a width that is disposed substantially along said length of said substantially rectangular-shaped raised portion of said substantially rectangular-shaped lateral adjusting plate assembly and to one side of said longitudinal centerline of said substantially rectangular-shaped raised portion of said substantially rectangular-shaped lateral adjusting plate assembly.

12. The tray as defined in claim 11, wherein said substantially rectangular-shaped raised portion of said substantially rectangular-shaped lateral adjusting plate assembly further has at least two laterally disposed arcuate-shaped throughslots with a width that are disposed on the opposite side of said longitudinal centerline of said substantially rectangular-shaped raised portion of said substantially rectangular-shaped lateral adjusting plate assembly and open into said longitudinally disposed rectangular-shaped throughslot of said substantially rectangular-shaped raised portion of said substantially rectangular-shaped lateral adjusting plate assembly, so that when lateral position of each of said pair of adjustable rear leg assemblies is to be adjusted each of said pair of adjustable rear leg assemblies, with said small disk of each of said pair of rear leg assemblies movable in said chamber of said substantially rectangular-shaped lateral adjusting plate assembly, is slid across said longitudinally disposed rectangular-shaped throughslot of said substantially rectangular-shaped raised portion of said substantially rectangular-shaped lateral adjusting plate assembly and into a selected one of said at least two laterally disposed arcuate-shaped throughslots of said substantially rectangular-shaped raised portion of said substantially rectangular-shaped lateral adjusting plate assembly, said diameter of said small disk of each of said pair of adjustable rear leg assemblies is greater than said width of said longitudinally disposed rectangular-shaped throughslot of said substantially rectangular-shaped raised portion of said substantially rectangular-shaped lateral adjusting plate assembly and greater than said width of each of said at least two laterally disposed arcuate-shaped throughslots of said substantially rectangular-shaped raised portion of said substantially rectangular-shaped lateral adjusting plate assembly, so that each of said pair of adjustable rear leg assemblies can not be unintentionally removed from the substantially rectangular-shaped lateral adjusting plate assembly during adjustment thereof.

13. The tray as defined in claim 12; further comprising a leg height adjusting rod that is removably insertable into said lateral throughbore of said free end assembly of each of said pair of adjustable front leg assemblies and of each of said pair of adjustable rear leg assemblies, so that said threaded rod of each of said pair of front leg assemblies and of each said pair of adjustable rear leg assemblies can be rotated, and extended from and retracted into, said tubular body of each of said pair of adjustable front leg assemblies and of each of said pair of adjustable rear leg assemblies.

* * * * *